US010016048B2

(12) United States Patent
Wehner

(10) Patent No.: US 10,016,048 B2
(45) Date of Patent: Jul. 10, 2018

(54) HANGING CHAIR

(71) Applicant: WORLDWIDE CREATIONS, LLC, Clio, MI (US)

(72) Inventor: Scott D. Wehner, Mt. Morris, MI (US)

(73) Assignee: Worldwide Creations, LLC, Clio, MI (US)

( * ) Notice: Subject to any disclaimer, the term of this patent is extended or adjusted under 35 U.S.C. 154(b) by 0 days.

(21) Appl. No.: 15/852,436

(22) Filed: Dec. 22, 2017

(65) Prior Publication Data

US 2018/0116380 A1 May 3, 2018

Related U.S. Application Data

(63) Continuation of application No. 15/277,105, filed on Sep. 27, 2016, now Pat. No. 9,861,181, which is a continuation of application No. 14/719,685, filed on May 22, 2015, now Pat. No. 9,468,284.

(60) Provisional application No. 62/039,530, filed on Aug. 20, 2014, provisional application No. 62/002,428, filed on May 23, 2014.

(51) Int. Cl.

| | |
|---|---|
| ***A63G 9/00*** | (2006.01) |
| ***A47D 13/00*** | (2006.01) |
| ***A45F 3/26*** | (2006.01) |
| ***A47C 3/025*** | (2006.01) |
| ***A47C 4/04*** | (2006.01) |
| ***A47C 4/18*** | (2006.01) |

(52) U.S. Cl.

CPC ..... *A45F 3/26* (2013.01); *A47C 3/0252* (2013.01); *A47C 3/0255* (2013.01); *A47C 4/045* (2013.01); *A47C 4/18* (2013.01)

(58) Field of Classification Search

CPC ..... A47C 3/0252; A47C 3/0255; A47C 4/045; A47C 4/181; A47C 3/32; A45F 3/26

USPC ..... 297/277, 273, 42, 45, 184.17; 5/120; 472/118

See application file for complete search history.

(56) References Cited

U.S. PATENT DOCUMENTS

| | | | | | |
|---|---|---|---|---|---|
| 3,528,657 | A | * | 9/1970 | Krupsky | A47D 13/105 297/277 |
| D278,549 | S | * | 4/1985 | Kristich | D21/823 |
| 5,097,545 | A | * | 3/1992 | Hooi | A47D 9/02 297/274 |
| D369,476 | S | * | 5/1996 | Quill | D6/344 |
| 5,588,702 | A | * | 12/1996 | Litwin | A47C 3/0255 297/172 |

(Continued)

*Primary Examiner* — Brian D Mattei

(74) *Attorney, Agent, or Firm* — Young Basile Hanlon & MacFarlane, P.C.

(57) ABSTRACT

A hanging chair that includes an upper frame member, a lower frame member, and a plurality of upright supports. The upper frame member is connectable to an external support structure and having a top plate and a bottom plate. The lower frame member has a top plate and a bottom plate. Each upright support having a first end and a second end. The first end of each upright support is connected to the upper frame member between the top plate and the bottom plate of the upper frame member. The second end of each upright support is connected to the lower frame member between the top plate and the bottom plate of the lower frame member. The plurality of upright supports are pivotally moveable between a collapsed position, where the plurality of upright supports are pivoted toward one another, and an expanded position.

20 Claims, 10 Drawing Sheets

(56) References Cited

U.S. PATENT DOCUMENTS

| | | | | |
|---|---|---|---|---|
| 5,918,615 | A * | 7/1999 | Stuck, Sr. | E04H 15/38 135/117 |
| 6,089,245 | A * | 7/2000 | Tseytlin | E04H 15/48 135/117 |
| 6,401,404 | B1 * | 6/2002 | Fillipp | B44C 5/00 362/249.04 |
| 6,848,740 | B1 * | 2/2005 | Reese | A47C 4/03 297/16.1 |
| 7,204,549 | B1 * | 4/2007 | Zeng | A47C 3/12 297/45 |
| 7,404,601 | B2 * | 7/2008 | Chen | A47C 4/44 297/16.1 |
| 7,967,374 | B2 * | 6/2011 | Akkad | A47C 4/24 297/16.1 |
| 2008/0203774 | A1 * | 8/2008 | Hemetsberger | A47C 1/14 297/16.2 |

* cited by examiner

HANGING CHAIR

CROSS-REFERENCE TO RELATED APPLICATIONS

This application is a continuation of U.S. patent application Ser. No. 15/277,105, filed on Sep. 27, 2016, which is a continuation of U.S. patent application Ser. No. 14/719,685, filed on May 22, 2015, now U.S. Pat. No. 9,468,284, which claims benefit of U.S. Provisional Application Ser. No. 62/002,428 filed on May 23, 2014 and U.S. Provisional Application Ser. No. 62/039,530 filed on Aug. 20, 2014, the disclosures of which are incorporated in their entireties by reference.

BACKGROUND

This disclosure relates to the field of hanging chairs. Hanging chairs of many types are well known. Hanging chairs generally include a mounting structure at the top of the chair, such as a hook or eye. The mounting structure is used to suspend the hanging chair from an external structure, such as an overhead structural member of a building or a frame. Hanging chairs lack legs, with the entire weight of the chair instead being borne by the mounting structure by which the chair is suspended.

One common type of hanging chair is known as an egg chair. A typical egg chair includes a half-ovoid shell that defines a seating surface and seat back, and an upright, substantially oval-shaped open side of the chair through which the occupant enters and sits in the chair. Traditionally, such a chair would be constructed from wicker or a similar material. Some recent designs define the shell with a frame of welded-together metal tubes. Many variations of this basic design have been made over the years, for example, some designs replace the half ovoid shape with a slightly more rectangular shape.

The weight of an occupant of a hanging chair is transmitted from a bottom interior surface of the chair through structure of the chair to the mounting structure. Because of this, the materials and construction techniques selected for the chair must be able to resist the tensile loading placed on nearly all of the chair's structure. This is in contrast to chairs having legs, where most of the structure of the chair is subjected to compressive forces.

SUMMARY

One aspect of the disclosed embodiments is a hanging chair that includes an upper frame member connectable to an external support structure, the upper frame member having a top plate, a bottom plate, and a side plate, and a lower frame member having a top plate, a bottom plate, and a side plate. A plurality of upright supports are each arcuate members that extend from the upper frame member to the lower frame member, each upright support having a first end and a second end, the first end of each upright support is pivotally connected to the upper frame member between the top plate and the bottom plate, the second end of each upright support is pivotally connected to the lower frame member between the top plate and the bottom plate, wherein two upright supports from the plurality of upright supports, the side plate of the upper frame member, and the side plate of the lower frame member define an opening.

Another aspect of the disclosed embodiments is a hanging chair that includes an upper frame member and a lower frame member. The upper frame member is connectable to an external support structure, the upper frame member having a top plate, a bottom plate, and a side plate, wherein the top plate and the bottom plate are substantially coplanar and spaced apart, wherein the side plate is connected to a portion of an outer periphery of the top plate and a portion of an outer periphery of the bottom plate. The lower frame member having a top plate, a bottom plate, and a side plate, wherein the top plate and the bottom plate are substantially coplanar and spaced apart, wherein the side plate is connected to a portion of an outer periphery of the top plate and a portion of an outer periphery of the bottom plate. The hanging chair also includes a plurality of upright supports that each extend from the upper frame member to the lower frame member, each upright support having a first end and a second end, the first end of each upright support is connected to the upper frame member between the top plate and the bottom plate, the second end of each upright support is connected to the lower frame member between the top plate and the bottom plate. The plurality of upright supports are pivotally moveable between a collapsed position, where the plurality of upright supports are pivoted toward one another, and an expanded position, and wherein two upright supports from the plurality of upright supports, the side plate of the upper frame member, and the side plate of the lower frame member define an ovoid opening. The hanging chair also includes a flexible cover that is connected to at least two of the upright supports.

Another aspect of the disclosed embodiments is a hanging chair that includes a frame, a cover, and a seat cushion. The frame includes a first frame member that is connectable to an external support structure having a top plate, a bottom plate, and a side plate, wherein the side plate is connected to a portion of an outer periphery of the top plate and a portion of an outer periphery of the bottom plate, a second frame member having a top plate, a bottom plate, and a side plate, wherein the side plate is connected to a portion of an outer periphery of the top plate and a portion of an outer periphery of the bottom plate, and a plurality of upright supports having a substantially arcuate configuration wherein each upright support extends from the first frame member to the second frame member, each upright support having a first end and a second end, the first end of each upright support is connected to the first frame member between the top plate and the bottom plate, the second end of each upright support is connected to the second frame member between the top plate and the bottom plate, wherein two upright supports from the plurality of upright supports define an ovoid opening, and wherein the lower frame member and the second end of each upright support form a support surface. The cover is connected to at least two of the upright supports and occupies spaces between adjacent pairs of bars, and terminates at the ovoid opening, such that the ovoid opening is not obstructed by the cover. The seat cushion supported on the support surface defined by the frame.

DETAILED DESCRIPTION

This disclosure is directed to hanging chairs, such as egg chairs, that have a folding frame that allows the chair to be collapsed for storage and transportation.

Figure 1:
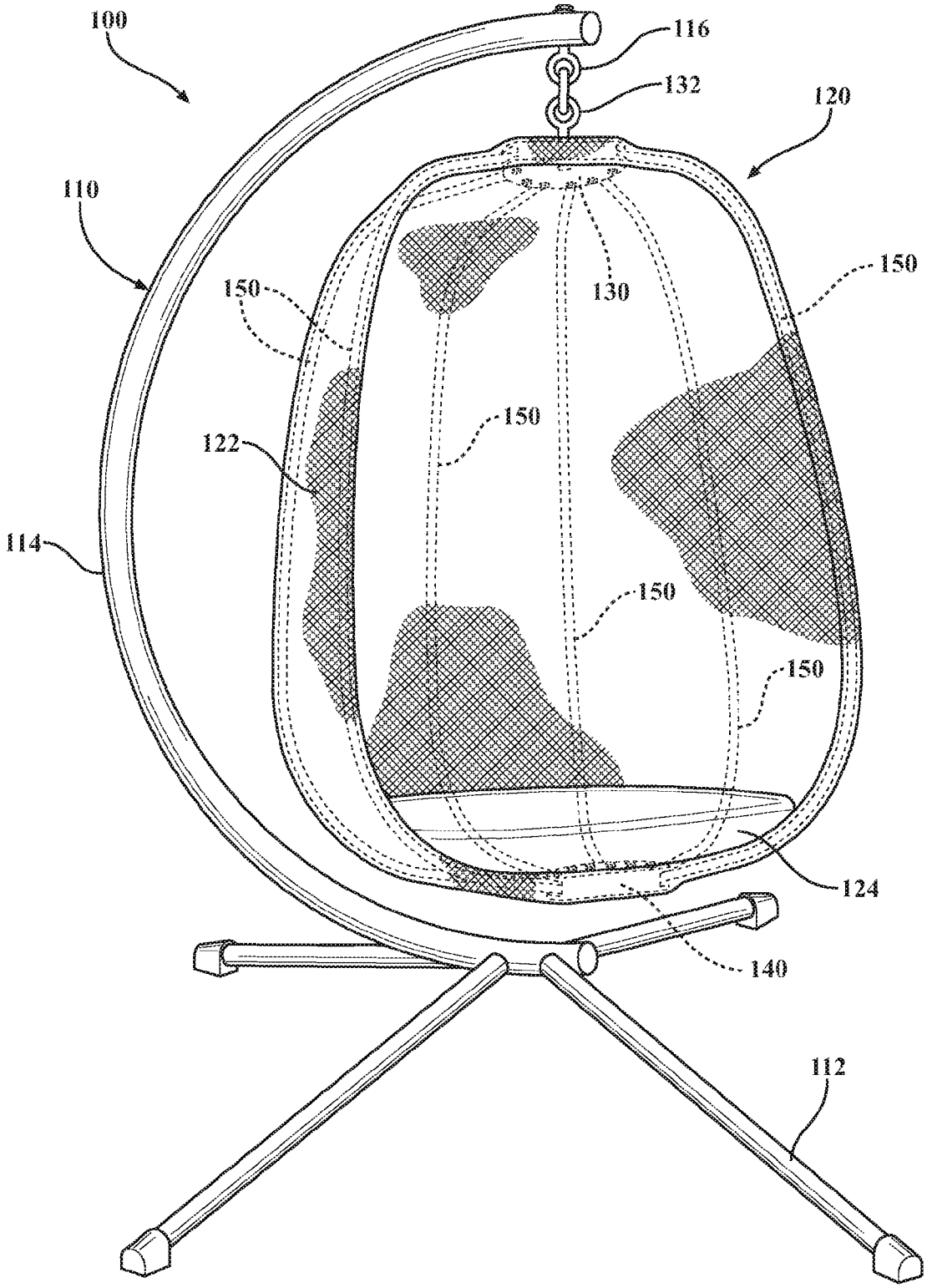
FIG. 1 is a perspective view showing an assembly that includes a suspension frame and a folding chair according to a first example.

FIG. 1 shows an assembly 100 that includes a suspension frame 110 and a folding chair 120. The folding chair 120 is suspended from the suspension frame 110. As illustrated, the suspension frame 110 is a free-standing includes a plurality of interconnected structural elements, such as welded-together tubular metal members. The suspension frame 110 includes a plurality of legs 112 that extend outward from an upstanding arcuate mast 114. In this example the arcuate mast has a C-shape with a first end of the mast 114 being connected to and supported by the legs 112 and a second end that is disposed directly above the first end, albeit with a substantial distance (e.g. six feet) separating the first end and the second end. A suspension member 116 is located at the second end of the mast 114. The suspension member is the portion of the suspension frame that is connectable to the folding chair 120. Accordingly, the suspension member is located at an elevation suitable for keeping the folding chair 120 separated from the ground or other underlying surface. The suspension member 116 can be, for example, a hook, an eye, or any other suitable.

The suspension frame 110 is an example of a structure from which the folding chair 120 can be suspended. The folding chair 120 can also be suspended from other structures such as a tree or an overhead structure of a building that is suitable for carrying suspended loads. In these examples, hardware similar to the suspension member 116 can be utilized to allow connection of the folding chair 120 to whatever external structure it is used in conjunction with.

The folding chair 120 includes a flexible cover 122 that is supported by a frame. The frame of the folding chair 120 includes an upper frame member 130, a lower frame member 140, and a plurality of upright supports 150. The upper frame member 130 and the lower frame member 140 are rigid members that interconnect the upright supports 150. The folding chair 120 can also include a seat cushion 124 that is disposed inside the folding chair 120, and is supported by the frame and the flexible cover 122 to define a seating surface. The flexible cover 122 may be of any configuration, including but not limited to, having pockets sewn into the flexible cover 122 to enclose the plurality of upright supports 150 or an opening to allow easy access to either the upper frame member 130 or the lower frame member 140.

Figure 2:
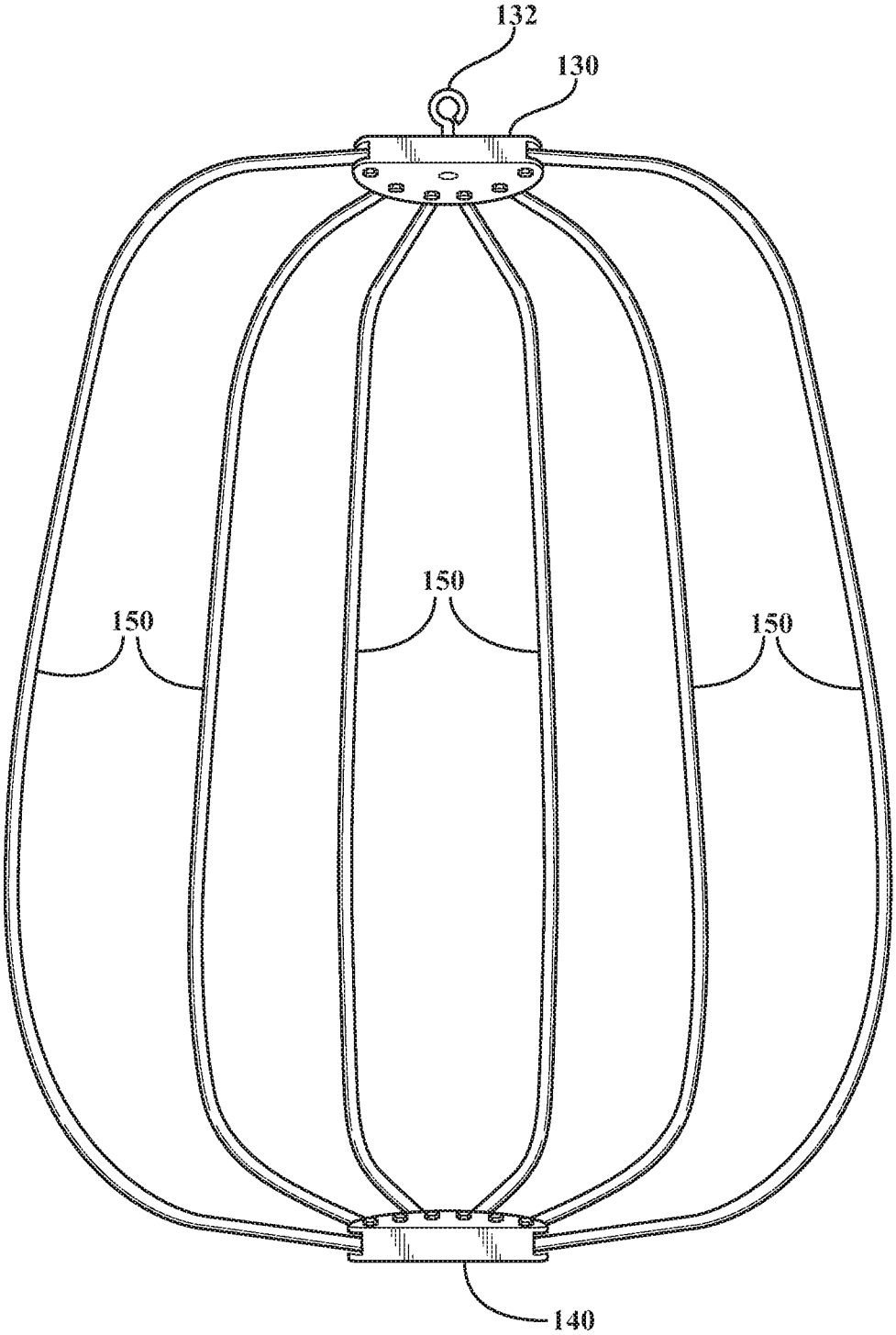
FIG. 2 is a front view of a frame of the folding chair of FIG. 1.

As shown in FIG. 2, the upper frame member 130 is connectable to an external support structure such as the suspension frame 110. A mounting member 132 is connected to and extends upward from the upper frame member 130 for connecting the upper frame member to the suspension frame 110 or other external support structure. For instance, the mounting member 132 can be a hook or an eye that is connectable to the suspension member 116 of the suspension frame 110.

Each of the upright supports 150 can have a lower end that is connected to the lower frame member 140 and each of the upright supports 150 can have an upper end that is connected to the upper frame member 130. To allow the chair to be folded and unfolded, each of the upright supports 150 is movable between a collapsed position and an expanded position. In particular, each of the upright supports 150 is pivotally connected to the lower frame member 140 and is also pivotally connected to the upper frame member 130.

At least some of the upright supports 150 are rigid members that are connected to the upper frame member 130 and the lower frame member 140 in a manner that allows force to be transmitted through the upright supports 150 to support and suspend the lower frame member 140 with respect to the upper frame member 130. In the illustrated example, all of the upright supports 150 are rigid. In some implementations, one or more of the upright supports 150 could be flexible supports that are connected to the upper frame member 130 and the lower frame member 140, semi-rigid supports that are connected to the upper frame member 130 and the lower frame member 140, or supports that are embedded in the flexible cover 122 without being connected to the upper frame member 130 or the lower frame member 140.

In the illustrated example, the upright supports 150 are rigid, tubular metal members having an arcuate shape, with each of the upright supports 150 being a solid, one-piece member. Other shapes, configurations, and materials can be used, such as non-tubular supports, extruded shapes, and/or multi-piece supports.

The flexible cover 122 is disposed over at least part of the frame, and typically covers the majority of the length of each of the upright supports 150. In combination with a pair of upright supports from the plurality of upright supports 150, the flexible cover defines an open side for the folding chair 120, which has a substantially ovoid opening that is defined between the pair of upright supports. The flexible cover 122 can be made from any of a number of suitable materials, such as canvas or nylon. Solid sheet fabrics materials can be used or other materials can be used such as screen, mesh, netting, or rope. Elastic or inelastic materials can be utilized for the flexible cover 122. Windows, vents, or other openings can be incorporated in the flexible cover 122. The flexible cover 122 can be removably attached to the upright supports 150 and/or other portions of the frame work of the folding chair 120 to allow the flexible cover 122 to be removed and replaced. Removable connection of the flexible cover 122 can be achieved by a number of suitable structures, including sleeves or straps that are formed as part of the flexible cover 122 and attach to the upright supports by hook-and-loop fasteners, zippers, buttons, snaps, knots, or other types of fasteners.

Figure 3:
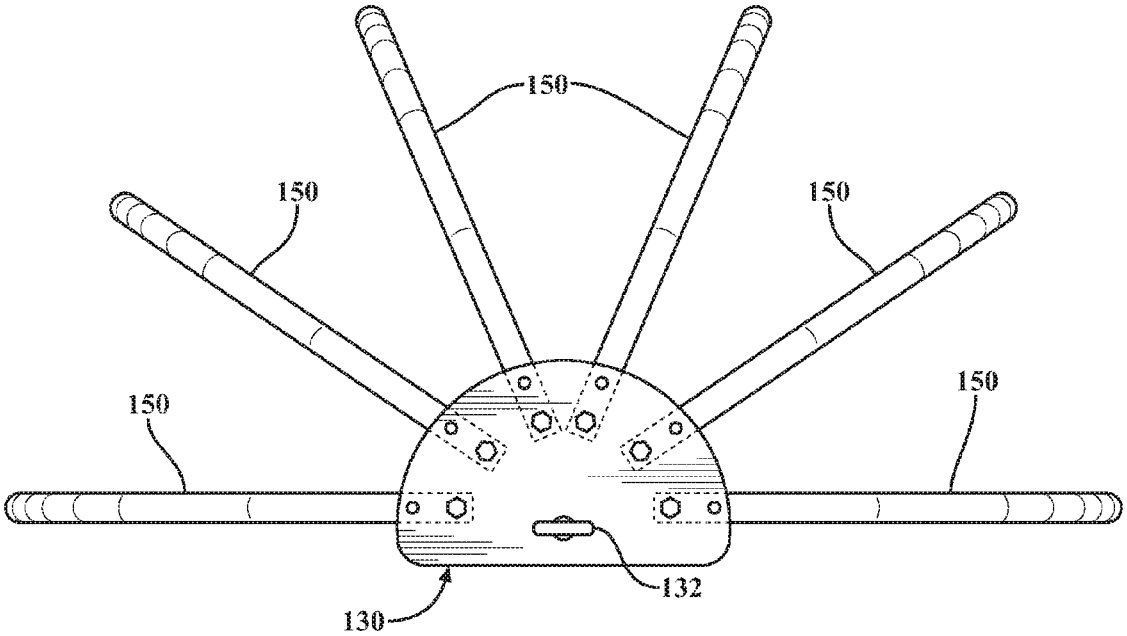
FIG. 3 is a top view of the frame of the folding chair of FIG. 1 in an expanded position.
Figure 4:
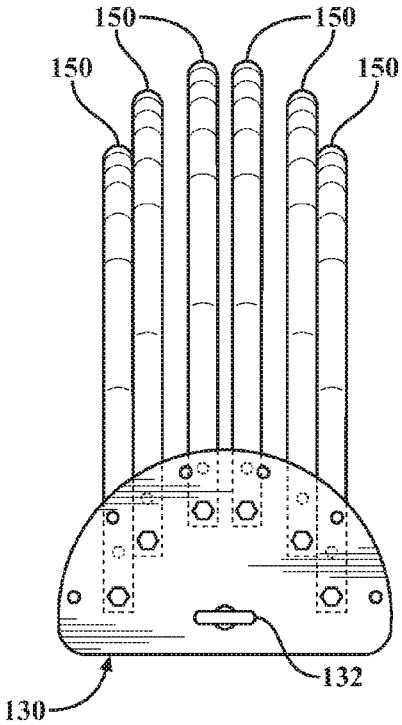
FIG. 4 is a top view of the frame of the folding chair of FIG. 1 in a collapsed position.

As seen in FIGS. 3-4, the upright supports 150 extend outward from the upper frame member 130 and the lower frame member 140 (not visible in FIGS. 3-4). In the expanded position (FIG. 3), the upright supports 150 extend radially outward from the upper frame member 130, with the mounting member 132 being located approximately at the radial center of the upright supports 150. In the collapsed position (FIG. 4), the upright supports 150 are pivoted toward one another to reduce the overall size of the frame.

Figure 5:
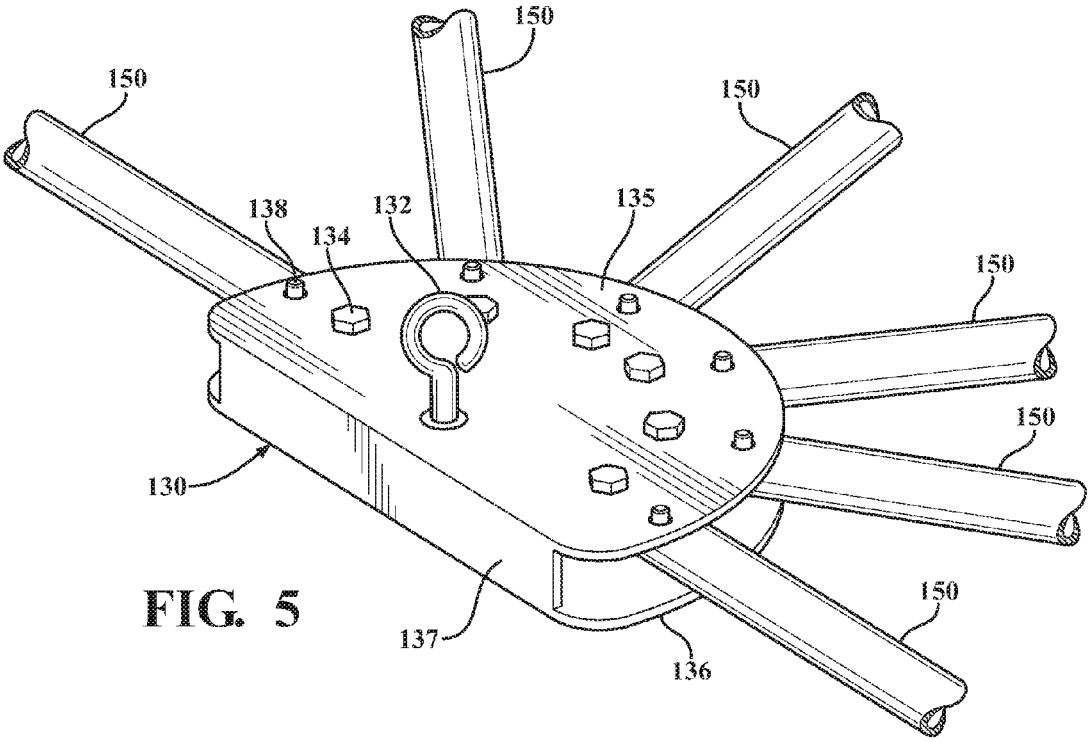
FIG. 5 is a detail view of an upper frame member and a plurality of upright supports of the folding chair of FIG. 1.
Figure 6:
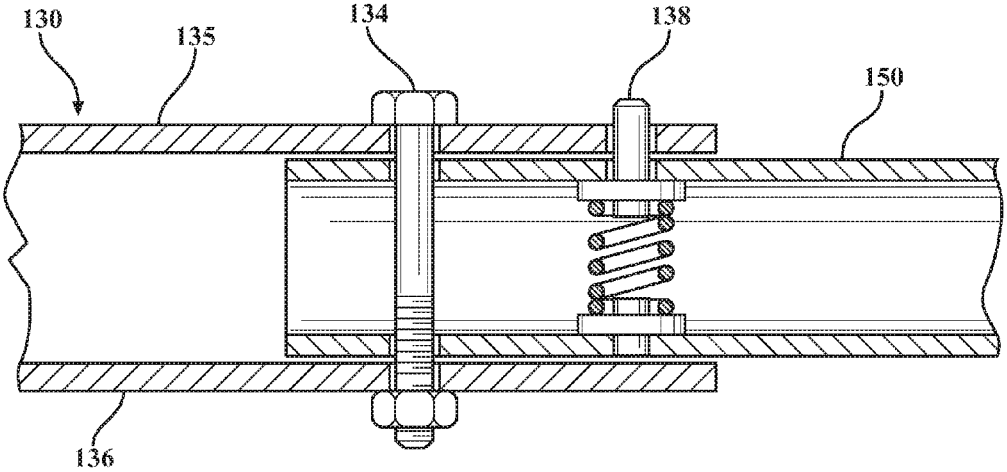
FIG. 6 is a cross-sectional view showing the upper frame member and an upright support from the plurality of upright supports.

To allow pivoting of the upright supports 150, each is connected to the upper frame member 130 by a pivot pin 134, as shown in FIGS. 5-6. The pivot pins 134 are arrayed on the upper frame member 130 at spaced locations to allow the upright supports 150 to pivot with respect to one another during movement between the expanded and collapsed positions. Each pivot pin 134 extends through aligned apertures in a top portion 135 and a bottom portion 136 of the upper frame member 130, which are spaced apart planar structures that are connected by a side portion 137. Each pivot pin 134 also extends through one of the upright supports 150. The pivot pins 134 can be fixed to the upper frame member 130, but sized and configured to allow the upright supports 150 to pivot on them. A releasable locking structure can be provided for each of the upright supports 150 to allow the upright supports 150 to be fixed in expanded position with respect to the upper frame member 130. As an example, a spring pin 138 can be disposed in each of the upright supports 150 and engageable with a respective aperture in the upper frame member 130. The spring pins 138 can each be axially compressed to disengage them from the upper frame member 130, which allows the upright supports 150 to be pivoted from the expanded position toward the collapsed position. Once re-aligned with the apertures in the upper frame member, the spring pins 128 extend and re-engage the upper frame member 130.

The lower frame member 140 is constructed in the same manner described with respect to the upper frame member 130 including connection of the upright supports 150 to the lower frame member 140 by pivot pins. Spring pins can be provided for engagement with the lower frame member 140 or omitted. If omitted, the upright supports 150 and the lower frame member 140 are maintained in position with respect to one another by engagement of the spring pins 138 with the upper frame member 130.

In operation, the folding chair 120 may initially be in the collapsed position and not connected to an external support structure. A user pivots each of the upright supports 150 with respect to upper frame member 130 and the lower frame member 140 and toward the expanded position. Once in the expanded position, the upright supports 150 are locked into position, for example, by engagement of the spring pins 138. If the flexible cover is not currently attached to the frame of the chair, it is connected to the upright supports 150 by the user. The folding chair 120 is then suspended from an external support structure, such as the suspension frame 110. For example, the folding chair 120 can be connected to the suspension frame 110 by connecting the mounting member 132 of the folding chair 120 to the suspension member 116 of the suspension frame 110. The seat cushion 124 is then installed in the folding chair 120, which is now ready for use. Disassembly of the folding chair 120 is accomplished by reversing the assembly steps.

Figure 7:
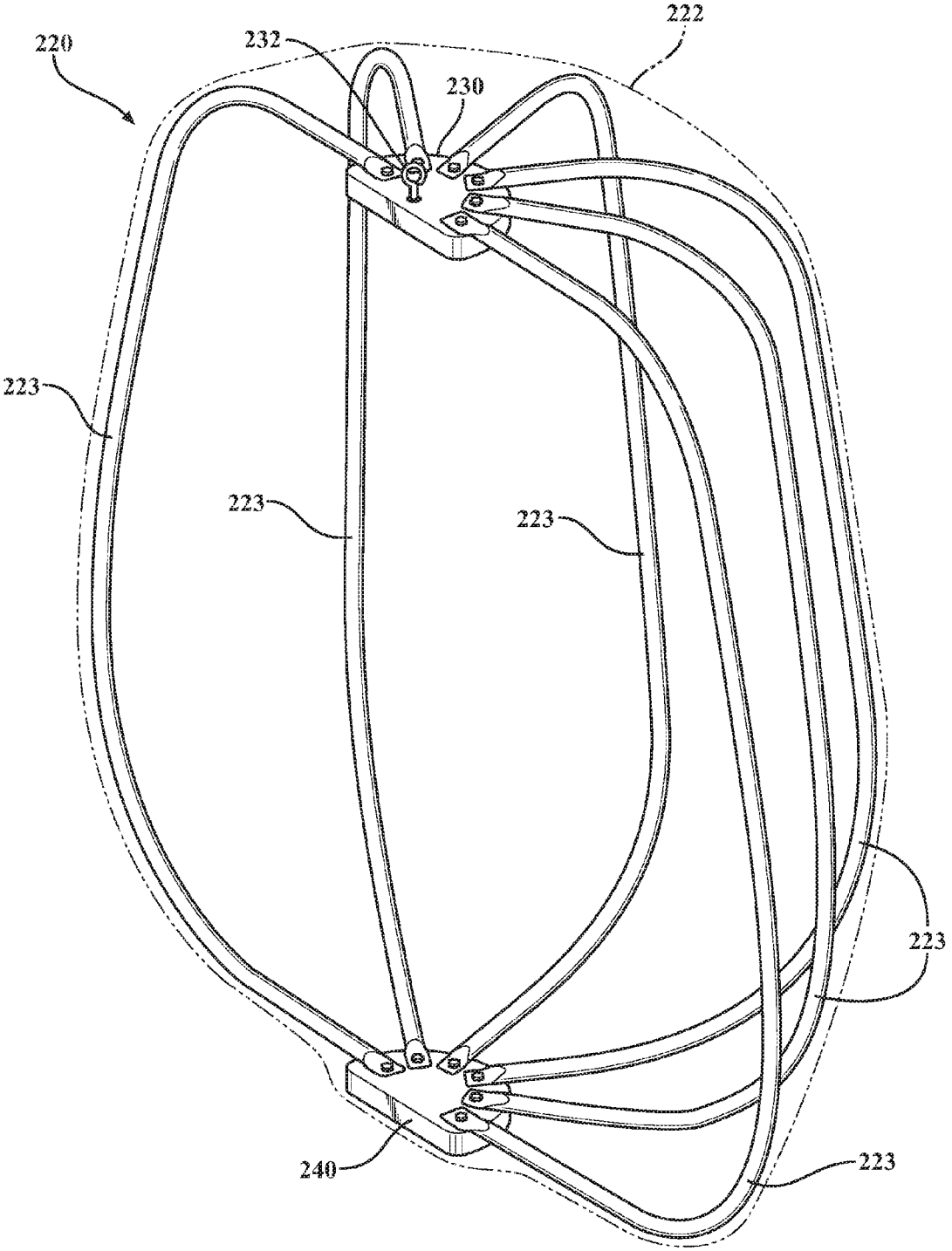
FIG. 7 is a perspective view showing a folding chair according to a second example.

FIG. 7 shows a folding chair 220 according to a second example. The folding chair 220 can be suspended from an external support structure, such as the suspension frame 110. The folding chair 220 includes a frame that supports a flexible cover 222, which is similar or identical to the flexible cover 122. The frame of the folding chair 220 includes an upper frame member 230 having a mounting member 232 as well as a lower frame member 240, which are similar to the upper frame member 130, the mounting member 132, and the lower frame member 140. The folding chair 220 differs from the folding chair 120 by virtue of a rigid, fixed, non-pivotal frame member 231 that is arcuate or substantially C-shaped and interconnects the upper frame member 230 and lower frame member to suspend the lower frame member 240 from the upper frame member. The non-pivotal frame member is fixedly connected to each of the upper frame member 230 and the lower frame member 240, and can be the sole structural connection between the two. A plurality of non-structural cover supports 223 are connected to each of the upper frame member 230 and the lower frame member 240 by one of a removable connection (i.e. disconnectable), or a pivotal connection to each of the upper frame member 230 and the lower frame member 240, where the folding chair 220 is moved to the collapsed position by pivoting and/or disconnecting the non-structural cover supports 223. As one example, the non-structural cover supports 223 are spring steel members. As another example, the non-structural cover supports 223 are fiber poles. As another example, the non-structural cover supports 223 are plastic rods. Use of the folding chair 220 is similar to use of the folding chair 120.

Figure 8:
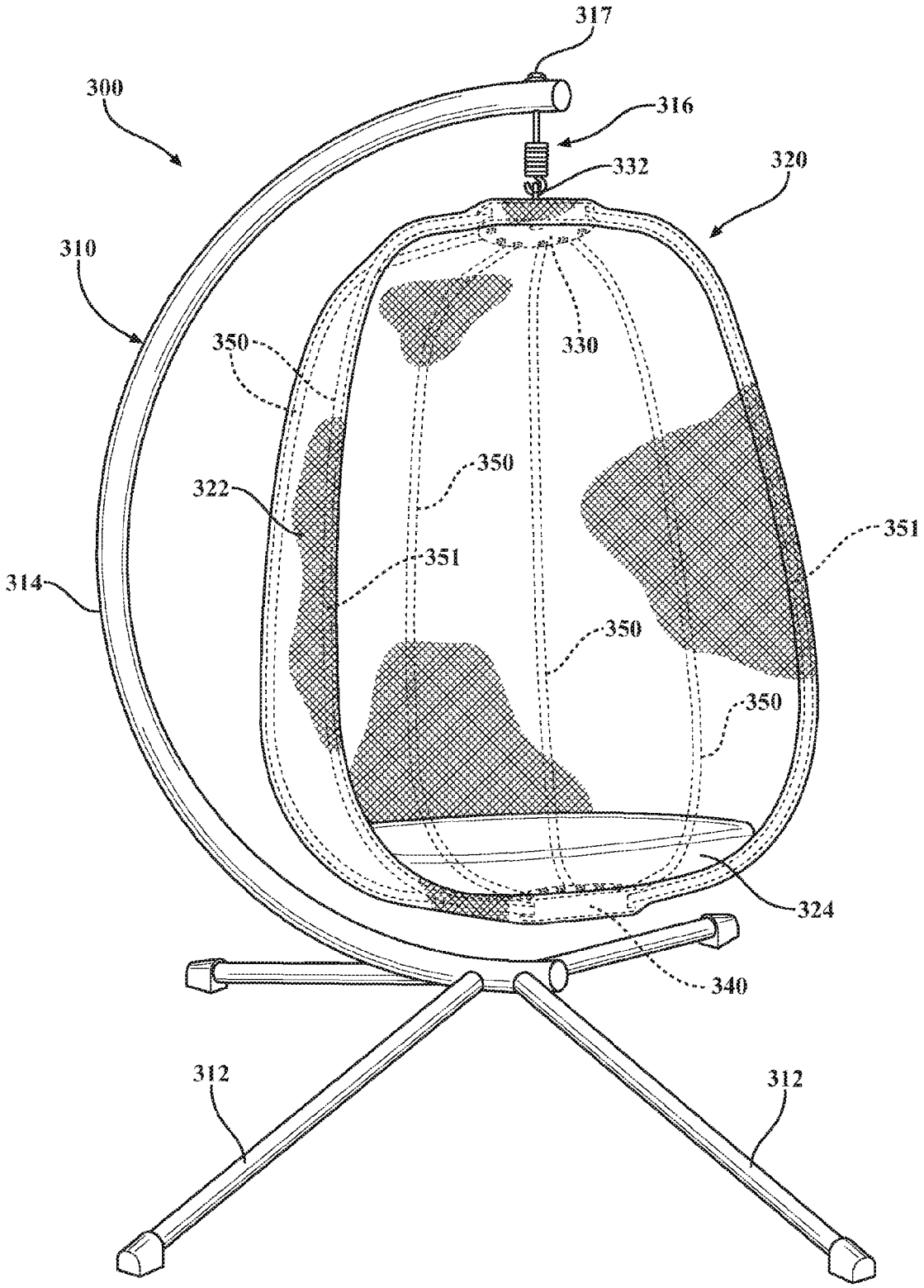
FIG. 8 is a perspective view showing a folding chair according to a third example.

FIG. 8 shows an assembly 300 according to a third example that includes a suspension frame 310 and a folding chair 320. The folding chair 320 is suspended from the suspension frame 310. As illustrated, the suspension frame 310 is free-standing and includes a plurality of interconnected structural elements, such as welded-together tubular metal members. The suspension frame 310 includes a plurality of legs 312 that extend outward from an upstanding arcuate mast 314. The arcuate mast may have a C-shape with a first end of the mast 314 being connected to and supported by the legs 312 and a second end that is disposed directly above the first end, albeit with a substantial distance (e.g. six feet) separating the first end and the second end. A suspension member 316 is located at the second end of the mast 314. The suspension member 316 is the portion of the suspension frame 310 that is connectable to the folding chair 320. Accordingly, the suspension member 316 is located at an elevation suitable for keeping the folding chair 320 separated from the ground or other underlying surface. The suspension member 316 can be, for example, a hook, an eye, or any other suitable. As shown, the suspension member 316 is a bolt 317 attached to a spring 318 with hooks on a free end. The bolt 317 extends through the second end of the mast 314 toward the folding chair 320. It is anticipated that the spring 318 could have hooks on both free ends.

The suspension frame 310 is an example of a structure from which the folding chair 320 can be suspended. The folding chair 320 can also be suspended from other structures, such as a tree or an overhead structure of a building that is suitable for carrying suspended loads. In these examples, hardware similar to the suspension member 316 can be utilized to allow connection of the folding chair 320 to the external structure the folding chair 320 is used in conjunction with.

The folding chair 320 includes a flexible cover 322 that is supported by a frame 360. The chair can also include a seat cushion 324 that is disposed inside the folding chair 320 and is supported by the frame 360 and the flexible cover 322 to define a seating surface (not shown). The frame 360 of the folding chair 320 includes an upper frame member 330, a lower frame member 340, and a plurality of upright supports 350. The upper frame member 330 and the lower frame member 340 are rigid members that interconnect the upright supports 350.

Figure 9:
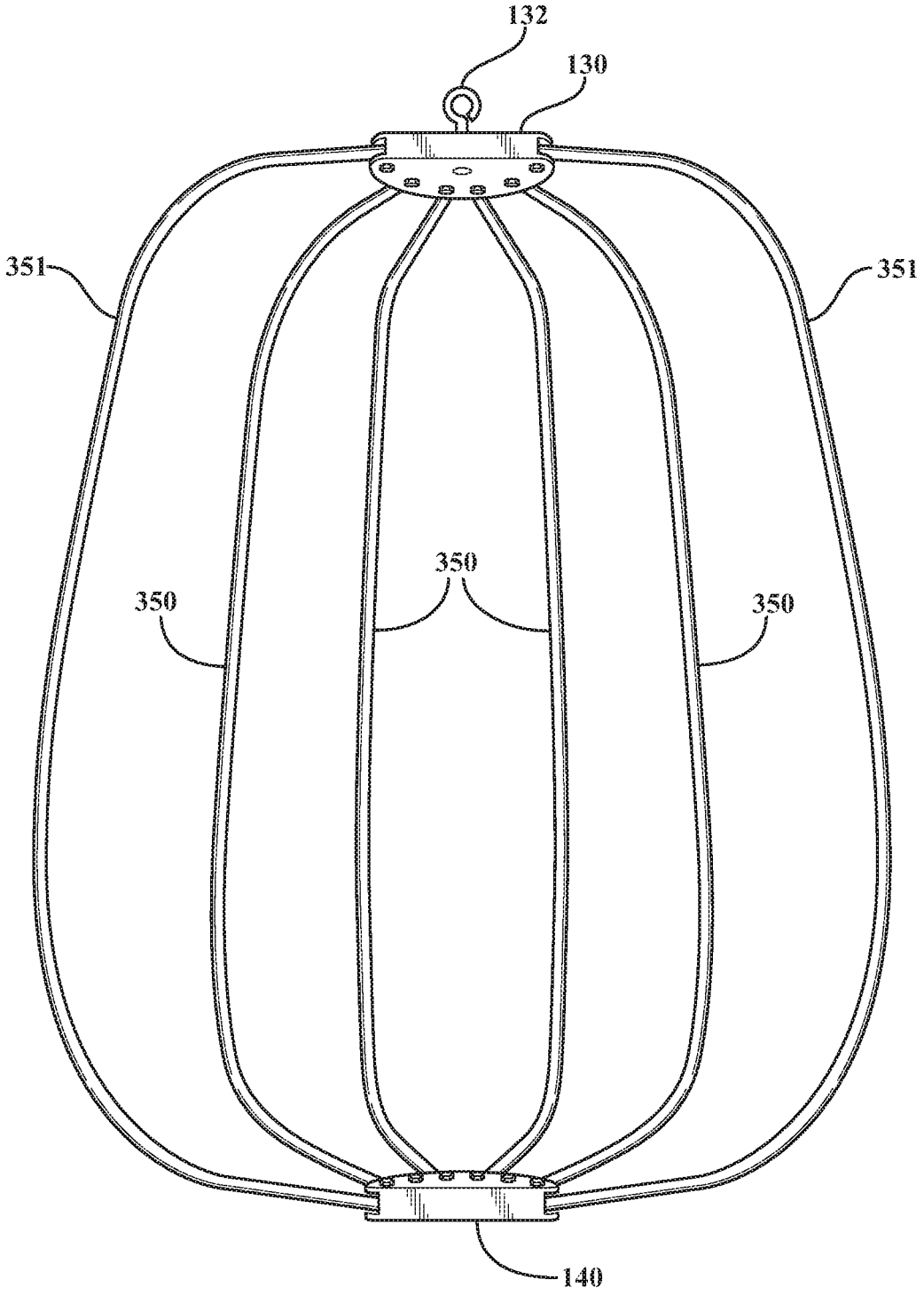
FIG. 9 is a front view of a frame of the folding chair of FIG. 8.

As shown in FIG. 9, the upper frame member 330 is connectable to an external support structure, such as the suspension frame 310. A mounting member 332 is connected to and extends upward from the upper frame member 330 for connecting the upper frame member to the suspension frame 310 or other external support structure. The mounting member 332 may be a hook or an eye that is connectable to the suspension member 316 of the suspension frame 310.

Each of the upright supports 350 can have a lower end that is connected to the lower frame member 340, and each of the upright supports 350 can have an upper end that is connected to the upper frame member 330. To allow the chair to be folded and unfolded, each of the upright supports 350 is movable between a collapsed position and an expanded position. In particular, each of the upright supports 350 is pivotally connected to the lower frame member 340 and is also pivotally connected to the upper frame member 330.

At least some of the upright supports 350 are rigid members that are connected to the upper frame member 330 and the lower frame member 340 in a manner that allows force to be transmitted through the upright supports 350 to support and suspend the lower frame member 340 with respect to the upper frame member 330. In some implementations, one or more of the upright supports 350 could be flexible supports that are connected to the upper frame member 330 and the lower frame member 340, semi-rigid supports that are connected to the upper frame member 330 and the lower frame member 340, or supports that are embedded in the flexible cover 322 without being connected to the upper frame member 330 or the lower frame member 340. As shown, the upright supports 350 are rigid, tubular metal members having an arcuate shape with each of the upright supports 350 being a solid, one-piece member. Other shapes, configurations, and materials can be used, such as non-tubular supports, extruded shapes, and/or multi-piece supports.

The flexible cover 322 is disposed over at least part of the frame 360, and typically covers the majority of the length of each of the upright supports 350. In combination with a pair of upright supports 351 from the plurality of upright supports 350, the flexible cover 322 defines an open side for the folding chair 320, which has a substantially ovoid opening that is defined between the pair of upright supports 351. The flexible cover 322 can be made from any of a number of suitable materials, such as canvas or nylon. Solid sheet fabrics materials could be used or other materials, such as screen, mesh, netting, or rope, could be used. Elastic or inelastic materials can be utilized for the flexible cover 322. Windows, vents, or other openings can be incorporated in the flexible cover 322. The flexible cover 322 can be removably attached to the upright supports 350 and/or other portions of the frame 360 of the folding chair 320 to allow the flexible cover 322 to be removed and replaced. Removable connection of the flexible cover 322 can be achieved by a number of suitable structures, including sleeves or straps that are formed as part of the flexible cover 322 and attach to the upright supports 350 by hook-and-loop fasteners, zippers, buttons, snaps, knots, or other types of fasteners.

Figure 10:
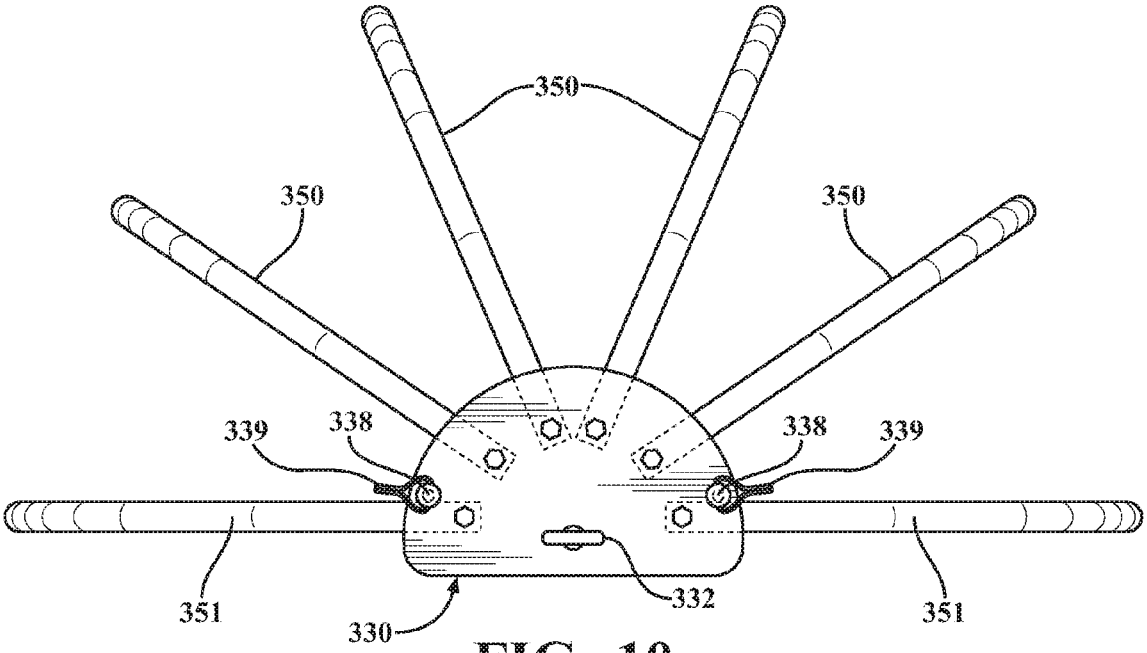
FIG. 10 is a top view of the frame of the folding chair of FIG. 8 in an expanded position.
Figure 11:
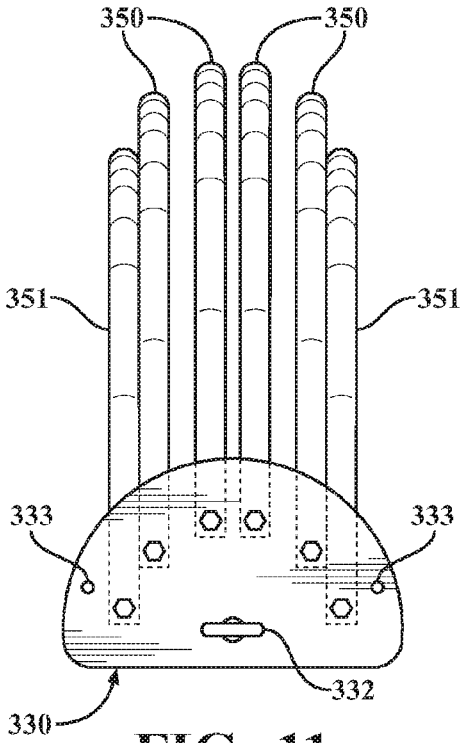
FIG. 11 is a top view of the frame of the folding chair of FIG. 8 in a collapsed position.

As seen in FIGS. 10-11, the upright supports 350 extend outward from the upper frame member 330 and the lower frame member 340 (not visible in FIGS. 10-11). In the expanded position (FIG. 10), the upright supports 350 extend radially outward from the upper frame member 330, with the mounting member 332 being located approximately at the radial center of the upright supports 350. In the collapsed position (FIG. 11), the upright supports 350 are pivoted toward one another to reduce the overall size of the frame 360.

Figure 12:
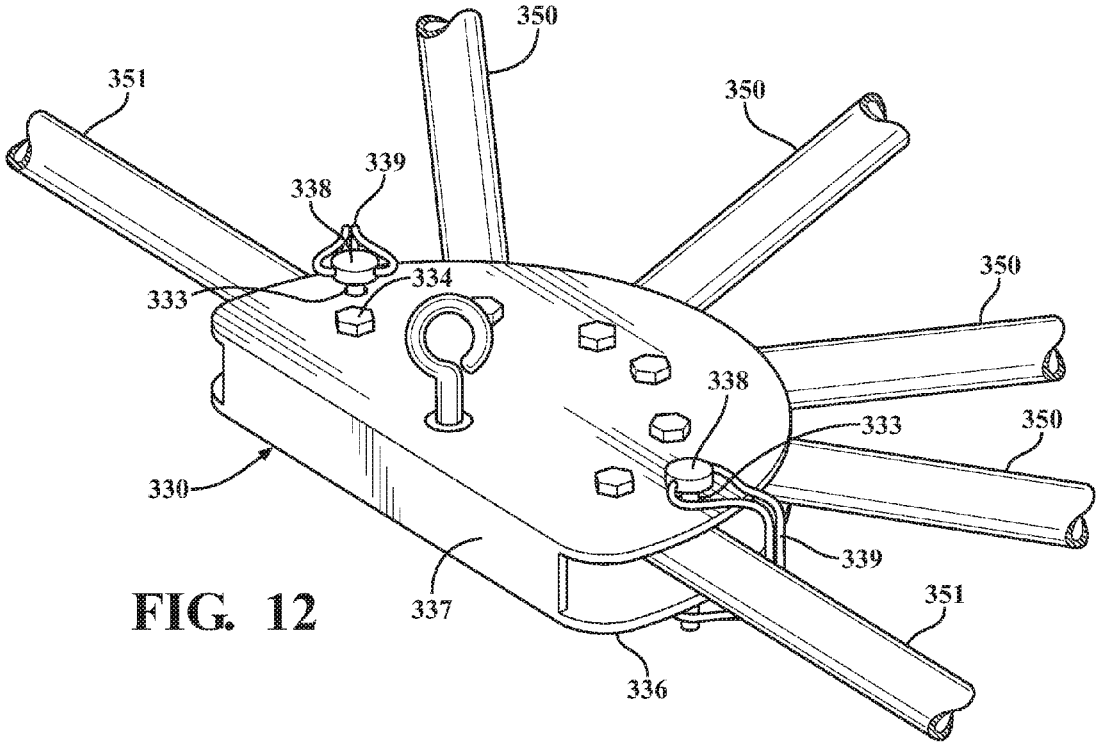
FIG. 12 is a detail view of an upper frame member and a plurality of upright supports of the folding chair of FIG. 8.
Figure 13:
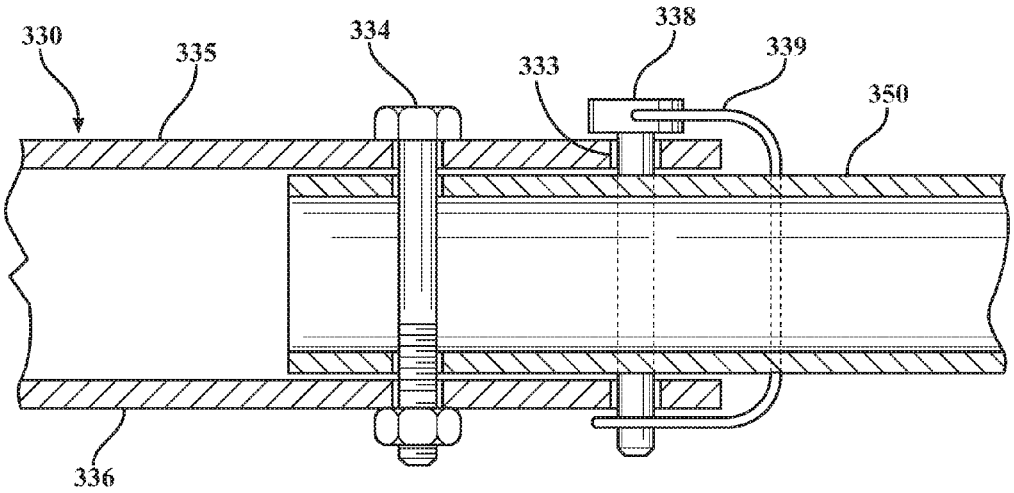
FIG. 13 is a cross-sectional view showing the upper frame member and an upright support from the plurality of upright supports of the folding chair of FIG. 8.

To allow pivoting of the upright supports 350, each is connected to the upper frame member 330 by a pivot pin 334, as shown in FIGS. 12-13. The pivot pins 334 are arrayed on the upper frame member 330 at spaced locations to allow the upright supports 350 to pivot with respect to one another during movement between the expanded and collapsed positions. Each pivot pin 334 extends through aligned apertures in a top portion 335 and a bottom portion 336 of the upper frame member 330, which are spaced apart planar structures that are connected by a side portion 337. Each pivot pin 334 also extends through one of the upright supports 350. The pivot pins 334 can be fixed to the upper frame member 330 but sized and configured to allow the upright supports 350 to pivot on them.

Locking structures can be provided to allow the pair of upright supports 351 that define the substantially ovoid opening to be fixed in expanded position with respect to the upper frame member 330. The locking structures are each disposed in a pair of substantially vertically aligned apertures 333 in the upper frame member. Each pair of vertically aligned apertures 333 is positioned at any point between one of the upright supports 351 that define the substantially ovoid opening and the closest upright support 350. As shown in FIG. 12, the vertically aligned apertures 333 are positioned closer to upright supports 351 that define the substantially ovoid opening than the closest upright support 350. The locking structure will extend through the upper frame member 330 but not the upright supports 350. In the illustrated example, the locking structures include pins 338 with clips 339. Each pin 338 would extend through one pair of substantially vertically aligned apertures 333 with one clip 339 connected to both ends of the pin 338 to secure the pin 338 to the upper frame member 330. The clips 339 are shown as being positioned between the upright supports 351 that define the substantially ovoid opening and the closest upright support 350. However, other configurations are anticipated, such as positioning the clips 339 between the upright supports 351 that define the substantially ovoid opening and the side portion 337. Other examples of locking structures include a pin without clips and a fastener such as a bolt that is secured to the upper frame member by a nut.

The lower frame member 340 is constructed in the same manner described with respect to the upper frame member 330, including the fixation of the pair of upright supports 351 the define the substantially ovoid opening by the locking structures. The locking structures can be provided or omitted. If omitted, the pair of upright supports 351 and the lower frame member 340 are maintained in position with respect to one another by engagement of the locking structures with the upper frame member 330.

In operation, the folding chair 320 may initially be in the collapsed position and not connected to an external support structure. A user pivots each of the upright supports 350 with respect to upper frame member 330 and the lower frame member 340 and toward the expanded position. Once in the expanded position, the pair of upright supports 351 that define the substantially ovoid opening are locked into position, for example, by locking structures such as pins 338 with clips 339. Thus, the upright supports 351 are substantially restrained from pivoting with respect to the upper frame member 330 and the lower frame member 340 by engagement of outside surfaces of the upright supports 351 with the locking structures, while the remainder of the upright supports 350 are able to pivot with respect to the upper frame member 330 and the lower frame member 340 over at least a limited range of motion. If the flexible cover 322 is not currently attached to the frame 360 of the folding chair 320, the flexible cover 322 is connected to the upright supports 350 by the user. The folding chair 320 is then suspended from an external support structure, such as the suspension frame 310. For example, the folding chair 320 can be connected to the suspension frame 310 by connecting the mounting member 332 of the folding chair 320 to the suspension member 316 of the suspension frame 310. The seat cushion 324 is then installed in the folding chair 320, which is now ready for use. Disassembly of the folding chair 320 is accomplished by reversing the assembly steps.

Figure 14:
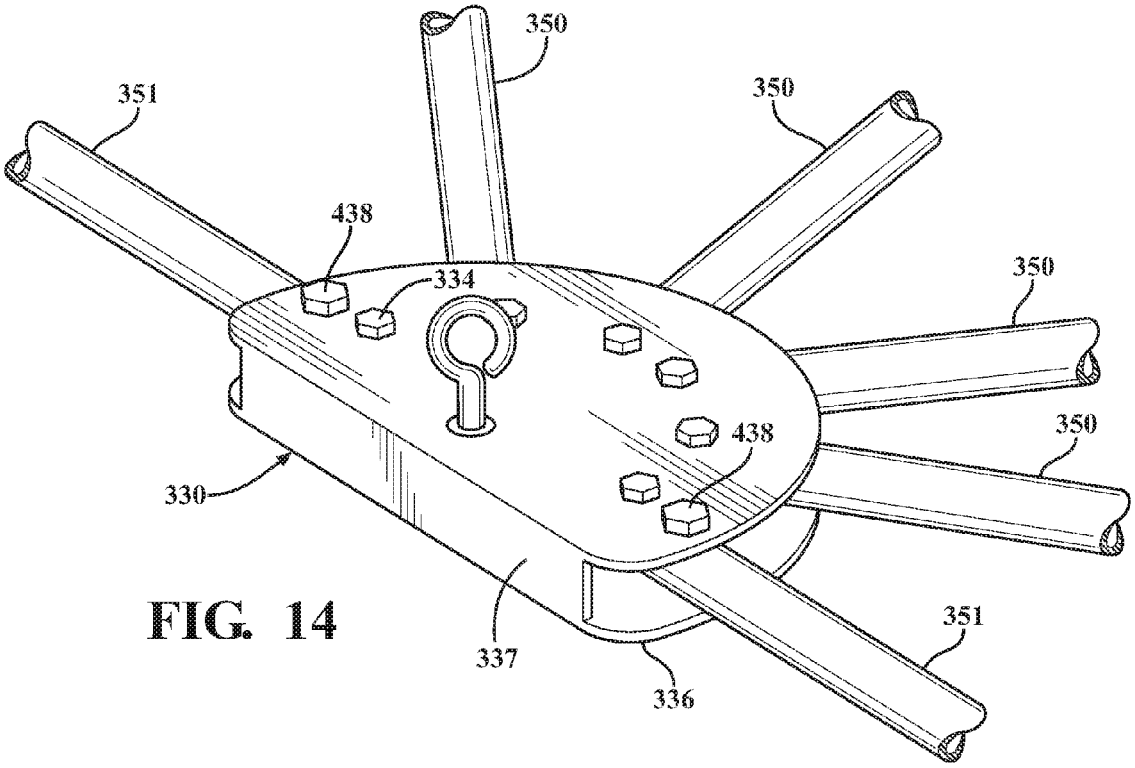
FIG. 14 is a detail view of an upper frame member and a plurality of upright supports in a first alternative embodiment of the folding chair of FIG. 8.
Figure 15:
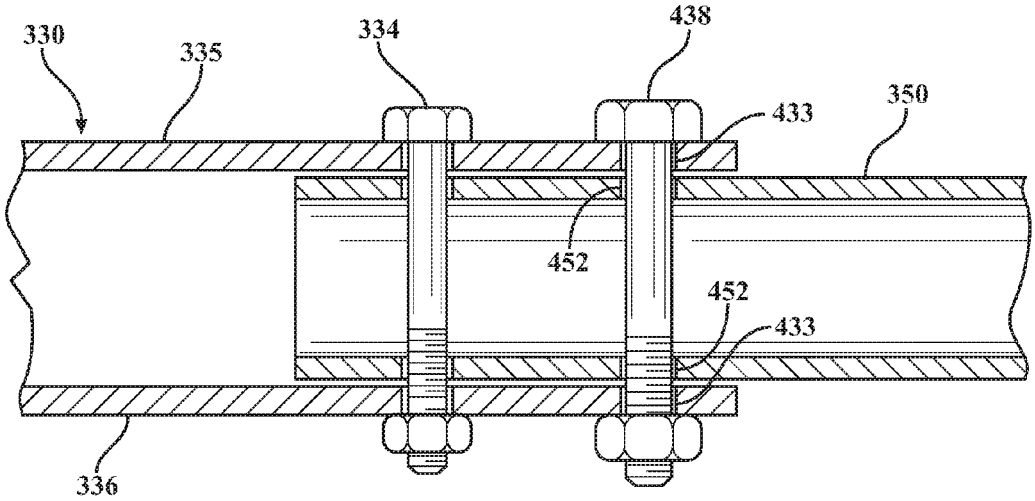
FIG. 15 is a cross-sectional view showing the upper frame member and an upright support from the plurality of upright supports in the first alternative embodiment of the folding chair of FIG. 8.

In the folding chair 320 of FIGS. 8-13, the pair of upright supports 351 that define the substantially ovoid opening are locked into position while the remainder of the upright supports 350 are not locked. FIGS. 14-15 show an upper frame member 430 according to an alternative embodiment in which the vertically aligned apertures 333 and associated locking structures are eliminated in favor of locking structures that extend through the pair of upright supports 351 that define the substantially ovoid opening, with the remainder of the upright supports 350 remaining unlocked. The upper frame member 430 can be incorporated in the folding chair 320, and the disclosure regarding the folding chair 320 applies equally to the alternative embodiment of FIGS. 14-15 except as otherwise noted herein.

The upper frame member 430 includes apertures 433 that are formed through it above and below each of the upright supports 351 that define the substantially ovoid opening when the upright supports 351 are in the fully expanded position. Corresponding apertures 452 are formed in the upright supports 351, such that the apertures 433 are aligned with the apertures 452 when the upright supports 351 are in the fully expanded position. Locking structures pass through the upper frame member 430 and through the upright supports 351 via the apertures 433 and the apertures 452 to lock the upright supports 351 into position with respect to the upper frame member 430 and prevent relative movement. In particular, relative movement is restrained by engagement of the locking structures with the apertures 433 and the apertures 452. In the illustrated example, the locking structure includes a bolt 438 and a nut 439. In another example the locking structure includes a pin and clip as explained with respect to FIGS. 12-13. In another example the locking structure includes a spring pin as described with respect to FIGS. 5-6. Use of the chair is the same as described previous with the exception that the locking structures are engaged with the apertures 433 and 452.

It is to be understood that the disclosure is not to be limited to the disclosed embodiments but, on the contrary, is intended to cover various modifications and equivalent arrangements included within the spirit and scope of the appended claims.

What is claimed is:

1. A hanging chair, comprising:

an upper frame member connectable to an external support structure, the upper frame member having a top plate, a bottom plate, and a side plate;

a lower frame member having a top plate, a bottom plate, and a side plate; and a plurality of upright supports that each are arcuate members that extend from the upper frame member to the lower frame member, each upright support having a first end and a second end, the first end of each upright support is pivotally connected to the upper frame member between the top plate and the bottom plate, the second end of each upright support is pivotally connected to the lower frame member between the top plate and the bottom plate, wherein two upright supports from the plurality of upright supports, the side plate of the upper frame member, and the side plate of the lower frame member define an opening.

2. The hanging chair of claim 1, further comprising:

a flexible cover that is connected to at least two of the upright supports.

3. The hanging chair of claim 2, wherein the flexible cover extends between adjacent pairs of the upright supports, and the flexible cover does not obstruct the opening defined by the upright supports.

4. The hanging chair of claim 3, wherein the flexible cover includes pockets that enclose the upright supports.

5. The hanging chair of claim 1, further comprising:

a free-standing, suspension frame having a suspension member, wherein the suspension member is connectable to the upper frame member.

6. The hanging chair of claim 5, wherein the upper frame member includes a mounting member for connecting the upper frame member to the suspension member.

7. The hanging chair of claim 1, wherein the upright supports are movable between a collapsed position and an expanded position, the hanging chair further comprising:

two releasable locking structures that allow the two upright supports that define the opening to be fixed in the expanded position.

8. The hanging chair of claim 1, wherein:

the side plate of the upper frame member is connected to a portion of an outer periphery of the top plate of the upper frame member and a portion of an outer periphery of the bottom plate of the upper frame member and wherein the top plate of the upper frame member and the bottom plate of the upper frame member are substantially coplanar and spaced apart, and the side plate of the lower frame member is connected to a portion of an outer periphery of the top plate of the lower frame member and a portion of an outer periphery of the bottom plate of the lower frame member and wherein the top plate of the lower frame member and the bottom plate of the lower frame member are substantially coplanar and spaced apart.

9. The hanging chair of claim 1, wherein at least some of the upright supports are rigid tubular members.

10. The hanging chair of claim 1, wherein at least some of the upright supports are non-structural cover supports.

11. A hanging chair, comprising:

an upper frame member connectable to an external support structure, the upper frame member having a top plate, a bottom plate, and a side plate, wherein the top plate and the bottom plate are substantially coplanar and spaced apart, wherein the side plate is connected to a portion of an outer periphery of the top plate and a portion of an outer periphery of the bottom plate;

a lower frame member having a top plate, a bottom plate, and a side plate, wherein the top plate and the bottom plate are substantially coplanar and spaced apart, wherein the side plate is connected to a portion of an outer periphery of the top plate and a portion of an outer periphery of the bottom plate;

a plurality of upright supports that each extend from the upper frame member to the lower frame member, each upright support having a first end and a second end, the first end of each upright support is connected to the upper frame member between the top plate and the bottom plate, the second end of each upright support is connected to the lower frame member between the top plate and the bottom plate, wherein the plurality of upright supports are pivotally moveable between a collapsed position, where the plurality of upright supports are pivoted toward one another, and an expanded position, and wherein two upright supports from the plurality of upright supports, the side plate of the upper frame member, and the side plate of the lower frame member define an ovoid opening; and a flexible cover that is connected to at least two of the upright supports.

12. The hanging chair of claim 11, wherein the flexible cover extends between adjacent pairs of the upright supports, and the flexible cover does not obstruct the ovoid opening defined by the upright supports.

13. The hanging chair of claim 12, wherein the flexible cover includes pockets that enclose the upright supports.

14. The hanging chair of claim 11, wherein the flexible cover is formed from an elastic material.

15. The hanging chair of claim 11, wherein the flexible cover is formed from an inelastic material.

16. The hanging chair of claim 11, wherein the flexible cover is configured to cover a majority of a length of each of the upright supports.

17. The hanging chair of claim 11, further comprising:

a plurality non-structural cover supports.

18. The hanging chair of claim 17, wherein the non-structural cover supports are embedded in the flexible cover.

19. The hanging chair of claim 17, wherein the non-structural cover supports are not directly connected to the upper frame member or the lower frame member.

20. A hanging chair, comprising:

a frame having:

a first frame member connectable to an external support structure having a top plate, a bottom plate, and a side plate, wherein the side plate is connected to a portion of an outer periphery of the top plate and a portion of an outer periphery of the bottom plate, a second frame member having a top plate, a bottom plate, and a side plate, wherein the side plate is connected to a portion of an outer periphery of the top plate and a portion of an outer periphery of the bottom plate, and a plurality of upright supports having a substantially arcuate configuration wherein each upright support extends from the first frame member to the second frame member, each upright support having a first end and a second end, the first end of each upright support is connected to the first frame member between the top plate and the bottom plate, the second end of each upright support is connected to the second frame member between the top plate and the bottom plate, wherein two upright supports from the plurality of upright supports define an ovoid opening, and wherein the lower frame member and the second end of each upright support form a support surface;

a cover that is connected to at least two of the upright supports and occupies spaces between adjacent pairs of bars, and terminates at the ovoid opening, such that the ovoid opening is not obstructed by the cover; and a seat cushion supported on the support surface defined by the frame.

* * * * *